United States Patent [19]

Nassauer

[11] Patent Number: 4,576,225

[45] Date of Patent: Mar. 18, 1986

[54] HEAT EXCHANGER FOR COOLING HOT GASES, ESPECIALLY THOSE DERIVING FROM THE SYNTHESIS OF AMMONIA

[75] Inventor: Konrad Nassauer, Berlin, Fed. Rep. of Germany

[73] Assignee: Borsig GmbH, Berlin, Fed. Rep. of Germany

[21] Appl. No.: 639,994

[22] Filed: Aug. 13, 1984

[30] Foreign Application Priority Data

Sep. 17, 1983 [DE] Fed. Rep. of Germany ..... 3333735

[51] Int. Cl.[4] ..... F28F 27/02; F28F 9/22; F28D 7/00

[52] U.S. Cl. ..... 165/101; 165/103; 165/140; 165/161

[58] Field of Search ..... 165/161, 145, 100, 101, 165/102, 103, 140, 141

[56] References Cited

U.S. PATENT DOCUMENTS

| | | | |
|---|---|---|---|
| 1,524,595 | 1/1925 | Sward | 165/161 |
| 1,651,900 | 12/1927 | Pagel | 165/34 |
| 2,340,138 | 1/1944 | Morris | 165/140 |
| 2,819,882 | 1/1958 | Stephani | 165/140 |
| 2,888,251 | 5/1959 | Dalin | 165/163 |
| 3,280,905 | 10/1966 | Costes | 165/145 |
| 3,316,961 | 5/1967 | Dorner | 165/145 |
| 3,363,679 | 1/1968 | Ernest | 165/141 |
| 3,376,917 | 4/1968 | Fristoe et al. | 165/145 |

FOREIGN PATENT DOCUMENTS

| | | | |
|---|---|---|---|
| 1014572 | 8/1957 | Fed. Rep. of Germany | 165/140 |
| 276246 | 10/1951 | Switzerland | 165/140 |
| 105351 | 4/1917 | United Kingdom | 165/101 |

*Primary Examiner*—William R. Cline
*Assistant Examiner*—John K. Ford
*Attorney, Agent, or Firm*—Max Fogiel

[57] ABSTRACT

A heat exchanger with two bundles of tubes is employed to cool the hot gases deriving from the synthesis of ammonia. The two bundles communicate directly at the incoming-gas end and through a reversing chamber positioned between them at the outgoing-gas end. The first bundle is surrounded by several chambers with separate media flowing through them. The second bundle is provided with still another separate medium flow-through.

3 Claims, 2 Drawing Figures

HEAT EXCHANGER FOR COOLING HOT GASES, ESPECIALLY THOSE DERIVING FROM THE SYNTHESIS OF AMMONIA

BACKGROUND OF THE INVENTION

The present invention relates to a heat exchanger for cooling hot gases, especially those deriving from the synthesis of ammonia, by means of preheated and evaporating water and consisting of a shell, in which a bundle of tubes that are secured in tube sheets connected to the shell is positioned, whereby an outgoing chamber and, inside it, an incoming chamber for the gases to be cooled are connected to one of the tube sheets and whereby partitions that create one or more chambers are positioned inside the shell.

A heat exchanger of this type is the object of the as yet unpublished German Patent Application P 3 302 304.2. The tubes in that heat exchanger are U tubes. The gas to be cooled flows through the bundle in a sequential heat exchange that involves two media. If the gas were to be cooled further by means of still another heat exchange involving a third medium, another assembly with pipelines to connect the two assemblies would be necessary.

A heat exchanger with bundles of either straight tubes or U tubes is known from German Offenlegungsschrift 2 753 469. Two media that are conveyed in parallel flows participate with heat exchange with a third medium.

SUMMARY OF THE INVENTION

The object of the present invention is to provide a heat exchanger in which one medium participates at different temperature stages with three other media.

This object is attained in accordance with the invention in that the tubes in the first bundle of tubes are secured in another tube sheet that a reversing chamber connects to, in that another bundle of tubes is positioned inside the shell, and in that the outgoing ends of the tubes of the second bundle empty into the reversing chamber.

The tubes in the second bundle can be secured in a third sheet that is connected to the shell and that, in conjunction with the second sheet and the shell, demarcates the reversing chamber.

The section of the shell that surrounds the second bundle of tubes can have connections for a separate medium to flow through.

An incoming chamber that the incoming ends of the tubes in the second bundle open into can be connected to the third tube sheet.

The incoming chamber that is connected to the third tube sheet can communicate through a connection pipe with the outgoing chamber that is connected to the first tube sheet.

A throttle or butterfly valve can be positioned in the connecting pipe.

The connecting pipe can be positioned along the longitudinal axis of the shell.

Thus, three assemblies can be accommodated within one system and the temperature of the medium in each assembly can be regulated separately. Furthermore, interior bypasses that the individual assemblies can be partly or completely avoided through are created.

A preferred embodiment of the invention will now be described with reference to the attached drawings.

DETAILED DESCRIPTION OF THE PREFERRED EMBODIMENTS

Figure 1:
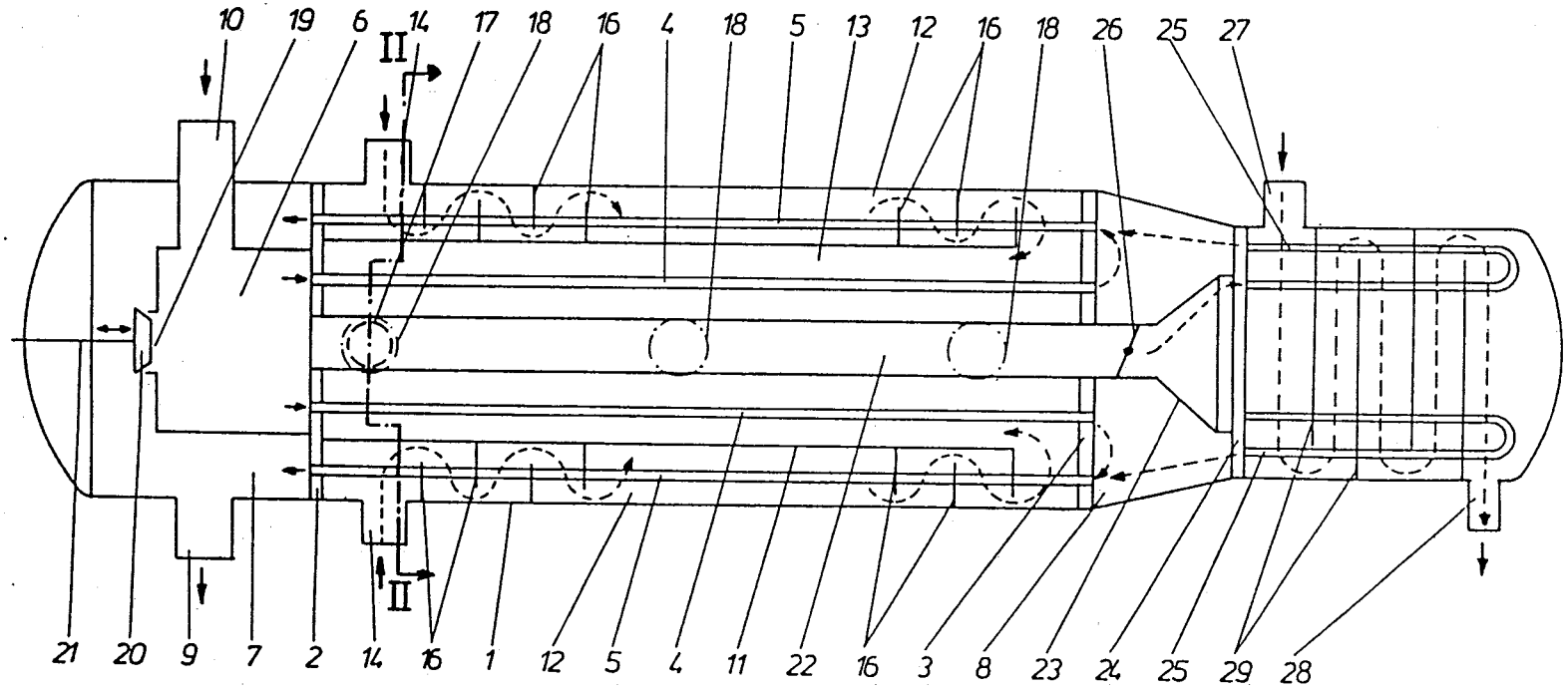
FIG. 1 is a longitudinal sectional view of a heat exchanger in accordance with the invention.
Figure 2:
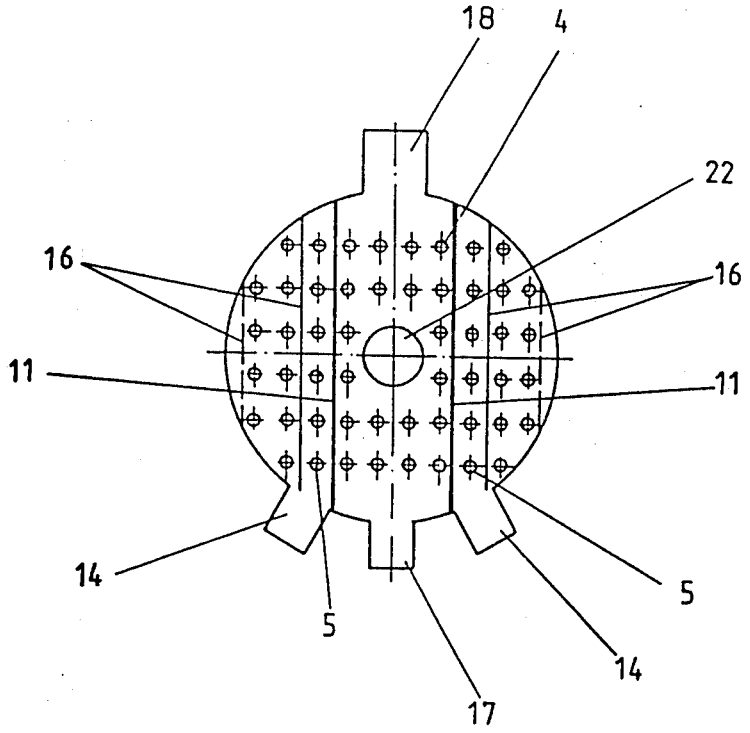
FIG. 2 is a transverse sectional view of FIG. 1, on the line II—II, looking in the direction of the arrows.

The illustrated heat exchanger is preferably employed to cool the hot gases leaving an ammonia converter. The heat exchanger is horizontal. It has a pressure-resistant shell 1. Two tube sheets 2 and 3 are connected to shell 1. Tubes 4 and 5 are inserted in the tube sheets. The hot gases that are to be cooled flow through the tubes.

The gases are conveyed in and out through an incoming chamber 6, an outgoing chamber 7, and a reversing chamber 8. Reversing chamber 8 is connected to second tube sheet 3. Outgoing chamber 7 is welded to the edge of first tube sheet 2 and is provided with an outgoing pipe 9. An incoming pipe 10 passes through outgoing chamber 7 into incoming chamber 6. Incoming chamber 6 is concentric with outgoing chamber 7 and connected to first tube sheet 2. The tubes 5 that open into outgoing chamber 7 are arrayed around the tubes 4 that extend from incoming chamber 6.

The hot gases flow through the heat exchanger in the direction indicated by the solid arrows. As they travel along this path through tubes 4 and 5, the gases are cooled with a coolant that is conveyed through the space outside the tubes. Partitions 11 that are connected with first tube sheet 2 and with shell 1 inside the shell create chambers 12. Chambers 12 surround the tubes 5 that the gases exit through, whereas the tubes 4 that the gases enter through pass through a central space 13 between the chambers.

Each chamber 12 has, in the vicinity of first tube sheet 2, an inlet pipe 14 that extends through shell 1. Mutually displaced baffle plates 16 are positioned perpendicular to tubes 5 in chambers 12. The medium to be heated will accordingly flow through chambers 12 in the direction indicated by the broken arrows, opposite to that in which the hot gases that are to be cooled are flowing, and, at the end of the chambers, enter central space 13. Central space 13 is provided with one or more inlet pipes 17 that extend through the bottom of shell 1 and with one or more outlet pipes 18 that extend through the top of shell 1.

Feed water is supplied to chambers 12. Once it has flowed through chambers 12, the heated feed water is introduced directly into central space 13, which functions as an evaporation space. Rising and falling lines to a steam-collecting drum communicate with the outlet pipes 18 and inlet pipes 17 to central space 13.

Incoming chamber 6 has, in the wall that parallels first tube sheet 2, in aperture 19 that connects it with outgoing chamber 7. In aperture 19 is a valve disk 20 that can be axially displaced from outside by means of a rod 21.

Depending on the position of valve disk 20, a particular proportion of the gas entering incoming chamber 6 can be conveyed directly to outgoing chamber 7 to establish a desired outgoing temperature for the outgoing gas.

A connecting pipe 22 also communicates with incoming chamber 6. Connecting pipe 22 extends through first tube sheet 2 along the longitudinal axis of shell 1. Connecting pipe 22 also extends through reversing chamber 8 and merges into an expansion 23. Expansion 23 is connected to a third tube sheet 24. Tube sheet 24 is connected to shell 1 and, in conjunction with it and with second tube sheet 3 demarcates reversing chamber 8.

The tubes 25 of another bundle are inserted in third tube sheet 24. This bundle is positioned inside and along the longitudinal axis of shell 1. It is a U-tube bundle. Its incoming flank is connected to connecting pipe 22 and its outgoing flank to reversing chamber 8. There is a throttle or butterfly valve 26 in connecting pipe 22. A controlled portion of the hot gases entering incoming pipe 10 are conveyed through throttle 26 parallel to tubes 4 to the tubes 25 of the second bundle. Once they have flowed through tubes 25, the gases leaving reversing chamber 8 are conveyed along with the gases leaving tubes 4 and entering reversing chamber 8 to outgoing chamber 7 through tubes 5.

The section of shell 1 that surrounds pipes 25 is provided with an inlet pipe 27 and an outlet pipe 28. Another medium that is to be heated but that is independent of the other media that are to be heated and that are supplied to chambers 12 and to central space 13, is conveyed through pipes 27 and 28. The third medium is preferably a gas. Mutually displaced baffle plates 29 are positioned perpendicular to tubes 25 inside shell 1 to make the medium flow in the direction indicated by the broken arrow.

What is claimed is:

1. Heat exchanger for cooling hot gases, particularly those deriving from the synthesis of ammonia, by preheated and evaporating water, comprising: a shell with bundles of tubes positioned therein; tube sheets connected to said shell, said tubes being secured in said tube sheets; outlet and inlet means for gases to be cooled comprising an outgoing chamber and an incoming chamber inside said outgoing chamber, said chambers being connected to a first one of said tube sheets; partitions forming at least one chamber within said shell, a reversing chamber connected to a second one of said tube sheets; a first bundle of said tubes being secured in said second tube sheet connected to said reversing chamber; said first bundle of said tubes being connected between said reversing chamber and said incoming and outgoing chambers; a second bundle of said tubes being positioned inside said shell, said second bundle of said tubes having outgoing ends emptying into said reversing chamber; valve means for regulating relative quantities of gases passed to said first bundle of tubes and said second bundle of tubes; means for cooling said first bundle of tubes and said second bundle of tubes by different cooling mediums for regulating the temperature of gases leaving said outgoing chamber; a third tube sheet connected to said shell, tubes in said second bundle being secured in said third sheet, said third sheet in conjunction with said second sheet and said shell forming borders of said reversing chamber; a section of said shell surrounding said second bundle of tubes having connections for a separate medium to flow through; said incoming chamber being connected to said third tube sheet by a connecting pipe, said second bundle having tubes with incoming ends opening into said connecting pipe; said valve means positioned in said connecting pipe; said connecting pipe being positioned along a longitudinal axis of said shell; said first bundle of tubes comprising two separate cooling means and said second bundle of tubes comprising a third separate cooling means, each of said cooling means being located in a separate chamber within said shell and each having its own inlet means and its own outlet means for allowing different cooling media to be used in the chambers of said three cooling means, gases to be cooled being divided into two partial flows, one partial flow being passed through a first one of said three cooling means, said partial flows when united passing through a second one of said three cooling means, the other partial flow being also passed through a third one of said three cooling means, each partial flow being cooled separately before the partial flows after being united are cooled in common cooling means for varying the final temperature of the gases to be cooled between substantially wide limits; said incoming chamber having means for releasing a portion of uncooled gas to said outgoing chamber to increase further variability of said final temperature.

2. Heat exchanger as defined in claim 1, wherein said valve means comprises throttle means.

3. Heat exchanger as defined in claim 1, wherein said valve means comprises butterfly valve means.

* * * * *